US011110721B2

(12) United States Patent
Shioya et al.

(10) Patent No.: US 11,110,721 B2
(45) Date of Patent: Sep. 7, 2021

(54) PRINTER

(71) Applicant: SATO HOLDINGS KABUSHIKI KAISHA, Tokyo (JP)

(72) Inventors: Takashi Shioya, Saitama (JP); Masaaki Kajikawa, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 16/607,130

(22) PCT Filed: Sep. 25, 2018

(86) PCT No.: PCT/JP2018/035519
§ 371 (c)(1),
(2) Date: Oct. 22, 2019

(87) PCT Pub. No.: WO2019/230011
PCT Pub. Date: Dec. 5, 2019

(65) Prior Publication Data

US 2021/0053365 A1 Feb. 25, 2021

(30) Foreign Application Priority Data

Jun. 1, 2018 (JP) ..... JP2018-106519

(51) Int. Cl.
*B41J 2/325* (2006.01)

(52) U.S. Cl.
CPC ..... *B41J 2/325* (2013.01)

(58) Field of Classification Search
CPC ..... B41J 32/00; B41J 2/325
See application file for complete search history.

(56) References Cited

U.S. PATENT DOCUMENTS

| | | | |
|---|---|---|---|
| 5,385,416 | A | 1/1995 | Maekawa et al. |
| 5,653,542 | A | 8/1997 | Sugimoto et al. |
| 6,215,508 | B1 | 4/2001 | Bryan et al. |
| 2003/0047635 | A1 | 3/2003 | Hiraoka et al. |
| 2005/0281602 | A1 | 12/2005 | Tu |
| 2007/0212148 | A1 | 9/2007 | Numata et al. |
| 2008/0193184 | A1 | 8/2008 | Daisuke |

(Continued)

FOREIGN PATENT DOCUMENTS

| | | |
|---|---|---|
| EP | 1 293 352 A1 | 3/2003 |
| EP | 2 284 014 A1 | 2/2011 |

(Continued)

OTHER PUBLICATIONS

USPTO Office Action, U.S. Appl. No. 16/605,840, dated Jun. 22, 2020, 9 pages.

(Continued)

*Primary Examiner* — Kristal Feggins
(74) *Attorney, Agent, or Firm* — Foley & Lardner LLP

(57) ABSTRACT

A printer includes a printing unit configured to print on the print medium, a ribbon shaft configured to hold the ink ribbon, a partition member provided swingably between a close position where gears that transmit drive force to the ribbon shaft mesh with each other and an open position where meshing between the gears is released, and a lock mechanism configured to hold the partition member with respect to the printing unit when the partition member is placed at the close position.

11 Claims, 8 Drawing Sheets

(56) References Cited

U.S. PATENT DOCUMENTS

| | | | | |
|---|---|---|---|---|
| 2010/0321458 | A1 | 12/2010 | Takeda | |
| 2011/0050832 | A1 | 3/2011 | Aihara et al. | |
| 2011/0058878 | A1 | 3/2011 | Maeda et al. | |
| 2012/0057917 | A1 | 3/2012 | Van Britsom et al. | |
| 2015/0145941 | A1 | 5/2015 | Gao et al. | |
| 2015/0165797 | A1 | 6/2015 | Chari et al. | |
| 2015/0165802 | A1 | 6/2015 | Wong et al. | |
| 2016/0325568 | A1 | 11/2016 | Onodera | |
| 2019/0118566 | A1 | 4/2019 | Mori et al. | |
| 2020/0047518 | A1* | 2/2020 | Kakui | B41J 35/28 |
| 2020/0130365 | A1 | 4/2020 | Maeda et al. | |

FOREIGN PATENT DOCUMENTS

| | | | |
|---|---|---|---|
| JP | 61-128052 | U | 8/1986 |
| JP | 05-162405 | A | 6/1993 |
| JP | 07-314866 | A | 12/1995 |
| JP | 2002-241005 | A | 8/2002 |
| JP | 2003-080783 | A | 3/2003 |
| JP | 2004-142113 | A | 5/2004 |
| JP | 2007-230157 | A | 9/2007 |
| JP | 2009-179010 | A | 8/2009 |
| JP | 2009-286000 | A | 12/2009 |
| JP | 2014-046606 | A | 3/2014 |
| JP | 2015-000532 | A | 1/2015 |
| JP | 2015-096336 | A | 5/2015 |
| JP | 2017-503684 | A | 2/2017 |
| WO | WO-2018/008568 | A1 | 1/2018 |

OTHER PUBLICATIONS

USPTO Office Action, U.S. Appl. No. 16/606,825, dated Jul. 31, 2020, 13 pages.

Extended European Search Report, Application No. 18863074.3, dated Oct. 29, 2020, 9 pages.

USPTO Notice of Allowance, U.S. Appl. No. 16/605,840, dated Sep. 22, 2020, 8 pages.

Notice of Allowance, U.S. Appl. No. 16/606,825, dated Dec. 14, 2020, 14 pages.

Supplemental Partial European Search Report, Application No. 18914943.8, dated Jul. 6, 2021, 66 pages.

* cited by examiner

PRINTER

TECHNICAL FIELD

The present invention relates to a printer.

BACKGROUND ART

JP2009-179010A discloses a thermal transfer printer in which an ink ribbon is heated and inks of the ink ribbon are transferred to a print medium, so that printing is performed.

In the above printer, at the time of replacing the ink ribbon, a spool shaft on which a new ink ribbon is wound is replaced.

SUMMARY OF INVENTION

In the printer disclosed in JP2009-179010A, it is difficult to stably feed the ink ribbon.

An object of the present invention is to provide a printer in which an ink ribbon is stably fed.

According to an aspect of the present invention, a printer that performs printing to a print medium by using an ink ribbon, includes a printing unit configured to print on the print medium, a ribbon shaft configured to hold the ink ribbon, a partition member swingably provided between a close position where gears that transmit drive force to the ribbon shaft mesh with each other and an open position where meshing between the gears is released, and a lock mechanism configured to hold the partition member with respect to the printing unit when the partition member is placed at the close position.

According to the present invention, at the time of activating the printer, the partition member is held at the close position by the lock mechanism. Thereby, the state where the gears that drive the ribbon shaft mesh with each other is held, and the ink ribbon is stably fed.

DESCRIPTION OF EMBODIMENTS

Hereinafter, a printer 100 according to an embodiment of the present invention will be described with reference to the attached drawings.

The printer 100 is a thermal transfer printer in which an ink ribbon R is heated and inks of the ink ribbon R are transferred to a print medium M, so that printing is performed. The print medium M is, for example, a label continuous body in which plural labels are continuously temporarily attached to a band-shaped liner sheet at predetermined intervals.

Figure 1:
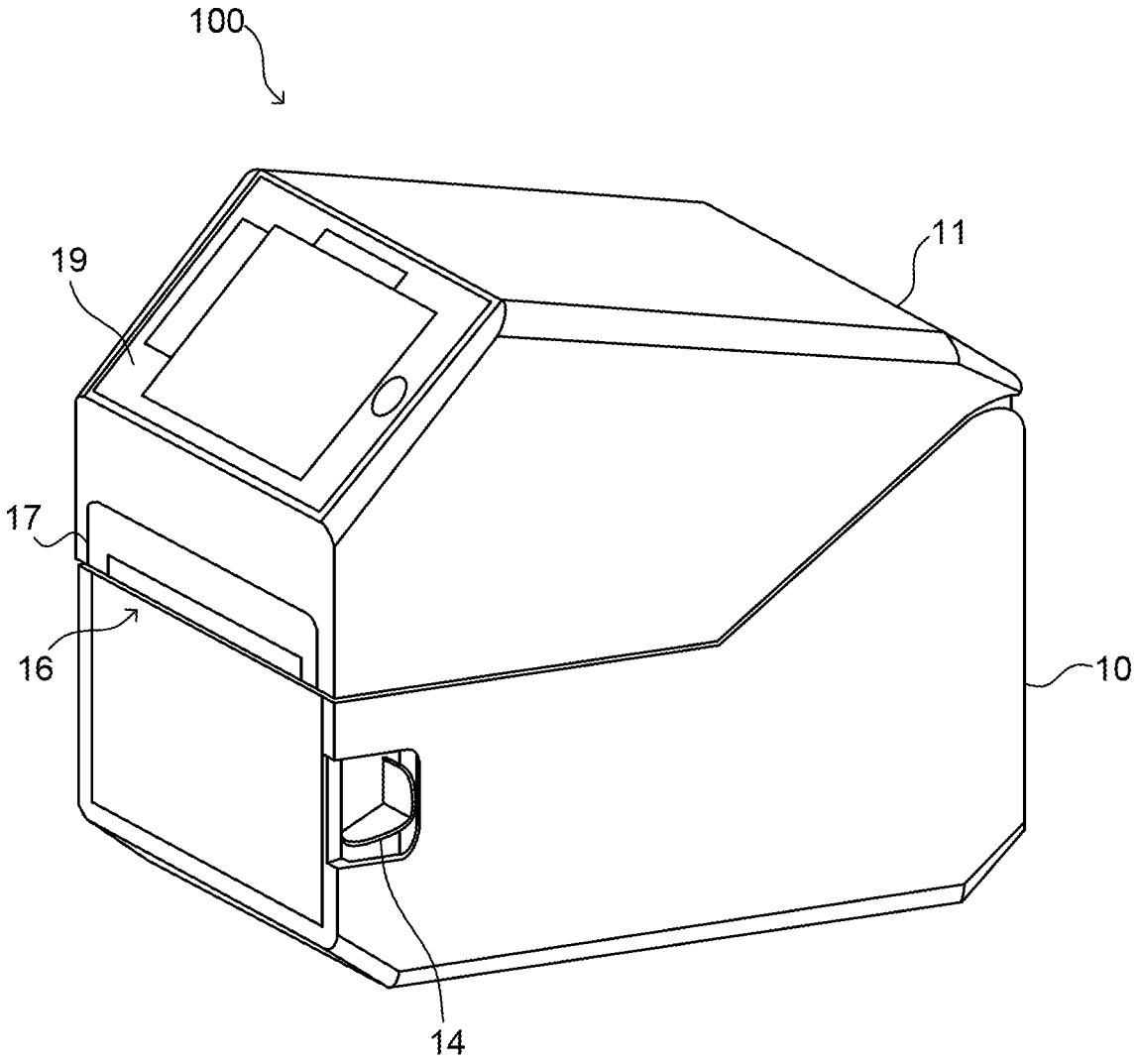
FIG. 1 is a perspective view of a printer 100 according to an embodiment of the present invention.
Figure 2:
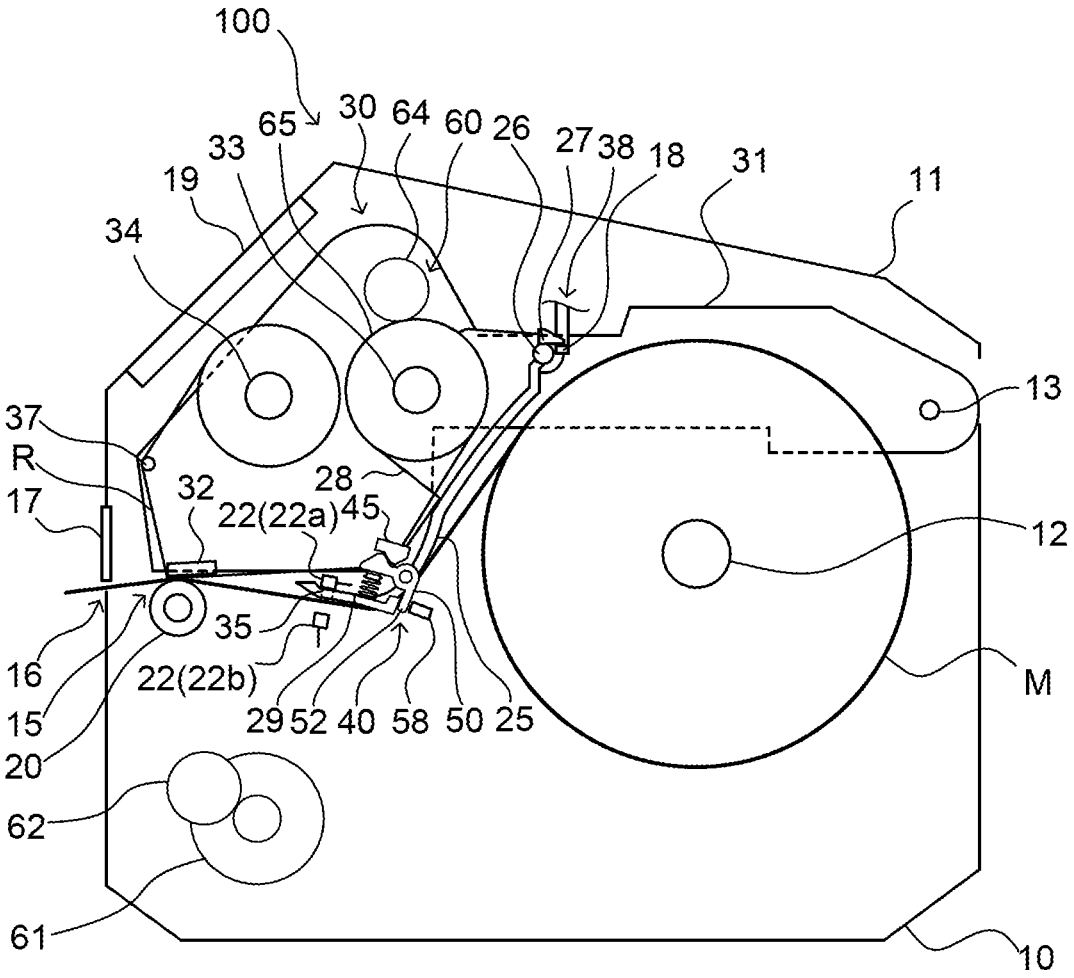
FIG. 2 is a schematic configuration view of the printer 100 according to the embodiment of the present invention.

As shown in FIGS. 1 and 2, the printer 100 includes a casing 10, and a cover 11 that covers an opening portion of the casing 10.

As shown in FIG. 2, the print medium M is held on a medium supply shaft 12 in a state where the print medium is wound in a roll form. As the print medium M, a linerless label or a fanfold medium can also be used.

A one-end side end portion of the cover 11 is supported by a support shaft 13 provided in the casing 10 so that the cover is swingable. By swinging with the support shaft 13 as a supporting point, it is possible to switch the cover 11 between a close position where the opening portion of the casing 10 is closed (see FIG. 2) and an open position where the opening portion of the casing 10 is opened (see FIGS. 3 and 4).

A cover lock mechanism (not shown) that maintains a close state of the cover 11 is provided in the casing 10. The cover lock mechanism is cancelled by operating a lever 14 shown in FIG. 1.

Between an other-end side end portion of the cover 11 and the casing 10, an outlet port 16 that discharges the print medium M to which printing is already performed by a printing portion 15 shown in FIG. 2 from the printer 100 is formed.

A cutter 17 facing the outlet port 16 is attached to the cover 11. The cutter 17 cuts the printed print medium M discharged from the outlet port 16. Note that it is possible to attach various other units to the cover 11 instead of the cutter 17.

An operation unit 19 for operating the printer 100 is also provided in the cover 11. The operation unit 19 has various operation buttons, a display, a near-field communication module, LEDs, etc. The display may be a touch panel.

As shown in FIG. 2, inside the printer 100, a printing unit 30 for performing printing on the print medium M is accommodated.

The printing unit 30 includes a main body portion 31 whose one end side is supported by the support shaft 13 so that the main body portion is swingable, and a thermal head 32 attached to the main body portion 31.

The thermal head 32 constitutes the printing portion 15 that performs printing on the print medium M together with a platen roller 20 provided on the casing 10 side.

The printing unit 30 also includes a ribbon supply shaft 33 that holds the ink ribbon R to be supplied to the printing portion 15 in a roll form, a ribbon roll up shaft 34 that rolls up the used ink ribbon R, a partition member 25 that partitions the ink ribbon R and the print medium M, a guide shaft 36 that defines a feed passage of the ink ribbon R from the ribbon supply shaft 33 to the printing portion 15 (see FIG. 4), and a guide shaft 37 that defines a feed passage of the ink ribbon R from the printing portion 15 to the ribbon roll up shaft 34. The ribbon supply shaft 33 is detachably attached to the partition member 25.

The print medium M is supplied from the medium supply shaft 12 to the printing portion 15, and nipped between the thermal head 32 and the platen roller 20 together with the ink ribbon R.

When electricity is distributed through to a heating element of the thermal head 32 in a state where the print medium M and the ink ribbon R are nipped between the thermal head 32 and the platen roller 20, that is, in a state where the printing unit 30 is placed at a printing position, the inks of the ink ribbon R are transferred to the print medium M by heat of the heating element, so that printing is performed to the print medium M.

A motor 61 serving as a power source, and a gear train 62 that transmits drive force of the motor 61 to the platen roller 20, etc. are provided in the casing 10. When the platen roller 20 is rotated forward by the drive force of the motor 61, the print medium M and the ink ribbon R are fed to the downstream side in the feed direction, and the print medium M is discharged to the outside of the printer 100 from the outlet port 16.

A gear train 60 that transmits the drive force of the motor 61 to the ribbon supply shaft 33 and the ribbon roll up shaft 34 is provided in the printing unit 30. At the time of activating the printing unit 30, a gear (not shown) of the gear train 62 and a gear (not shown) of the gear train 60 mesh with each other, and the power of the motor 61 is transmitted to the ribbon supply shaft 33 and the ribbon roll up shaft 34.

Figure 3:
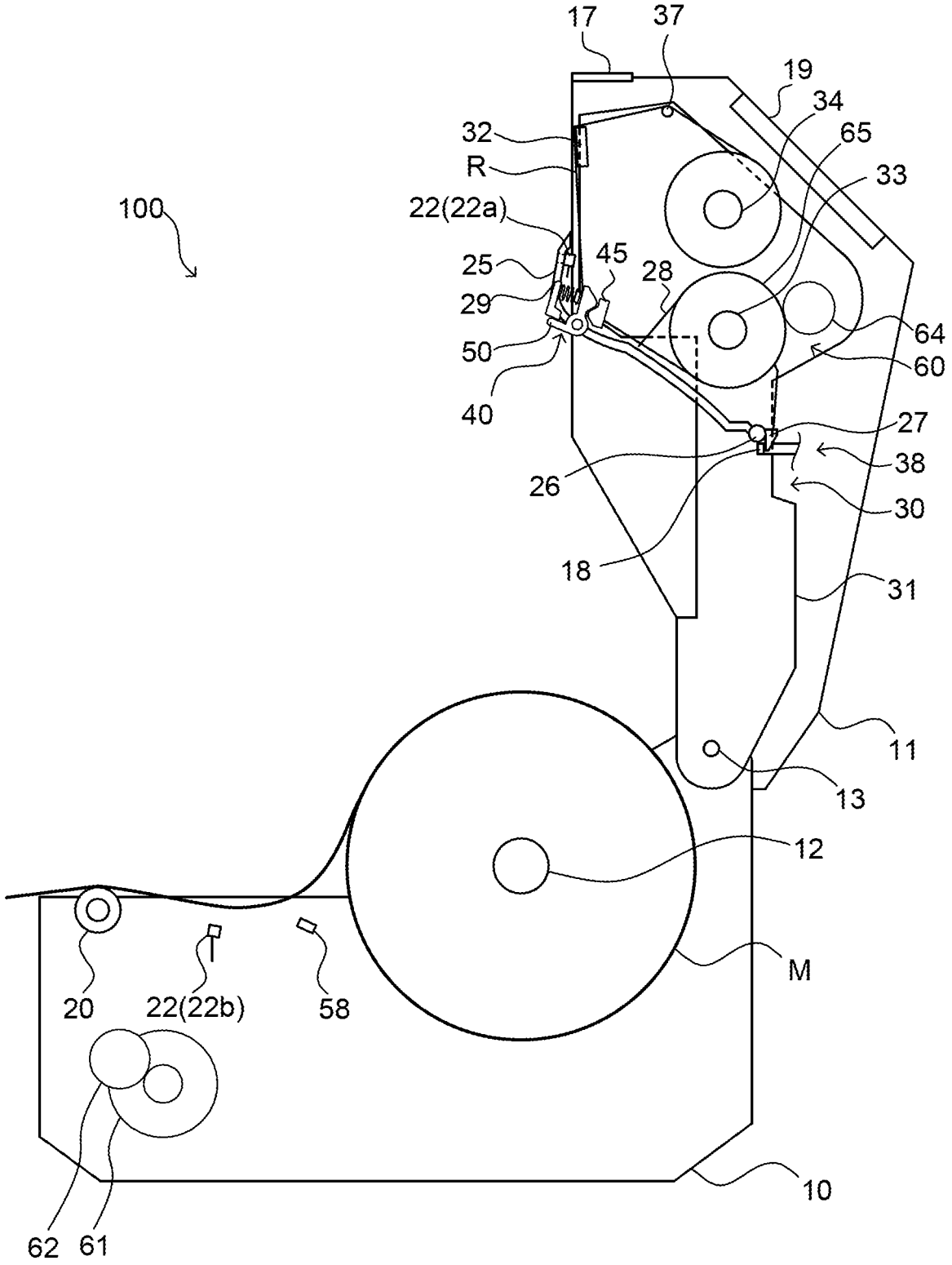
FIG. 3 is a view showing a state where a cover 11 is opened.
Figure 4:
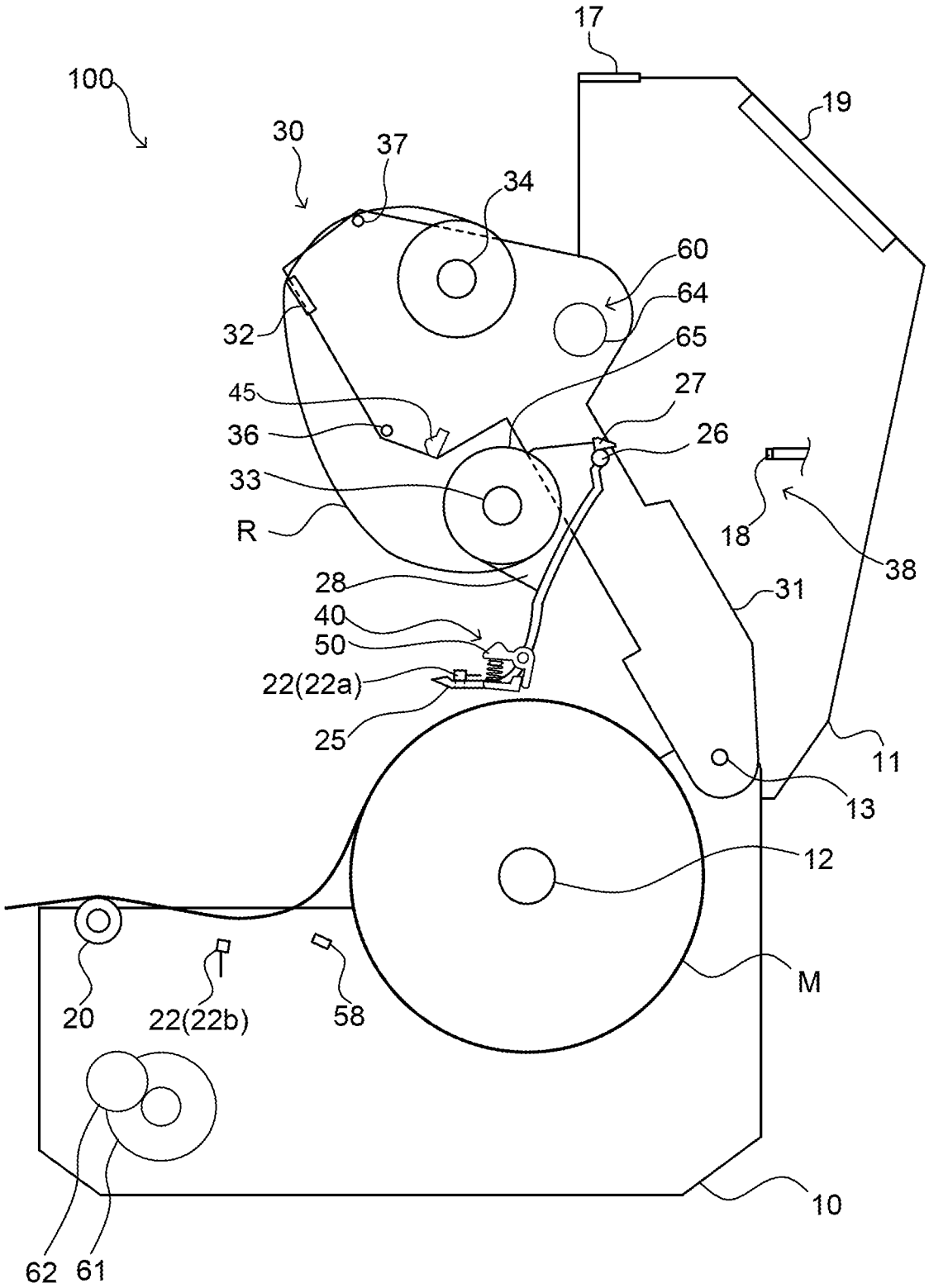
FIG. 4 is a view showing a state where a partition member 25 is opened.

By swinging with the support shaft 13 as a supporting point with respect to the casing 10 together with the cover 11, the printing unit 30 is switched between the printing position where the printing unit is accommodated in the casing 10 and the print medium M is nipped between the thermal head 32 and the platen roller 20 (see FIG. 2), and a non-printing position where the thermal head 32 is separated from the platen roller 20 (see FIGS. 3 and 4).

The partition member 25 is supported by a swing shaft 26 swingably with respect to the main body portion 31. By swinging with the swing shaft 26 as a supporting point with respect to the main body portion 31, the partition member 25 is switched between a close position where the ribbon supply shaft 33 is accommodated in the printing unit 30 (see FIG. 3), and an open position where the ribbon supply shaft 33 is attachable and detachable (see FIG. 4). At the close position, a gear 64 and a gear 65 of the gear train 60 mesh with each other, and the drive force of the motor 61 is transmitted to the ribbon supply shaft 33. Meanwhile, at the open position, meshing between the gear 64 and the gear 65 of the gear train 60 is released.

When the printer 100 is brought into a printable state, that is, into the state shown in FIG. 2, the partition member 25 is automatically brought into a state of guiding the print medium M. The partition member 25 has guiding surfaces 29 with which the print medium M is brought into sliding contact. In sliding contact with the ink ribbon R fed from the guide shaft 36 to the printing portion 15, the guiding surfaces 29 define the feed passage of the ink ribbon R.

The printer 100 also includes a light transmission sensor 22 that detects a position of the print medium M in the feed direction.

The light transmission sensor 22 is a sensor having a light emitting unit 22*a* which serves as a light emitting portion that emits predetermined light, and a light receiving unit 22*b* which serves as a light receiving portion that receives the light emitted from the light emitting unit 22*a* and outputs an electric signal corresponding to intensity of the received light.

For example, in a case where the print medium M is a label continuous body in which plural labels are continuously temporarily attached to a band-shaped liner sheet at predetermined intervals, there is an only-liner part between two adjacent labels. Between the label part and the only-liner part, a transmission amount of the light emitted from the light emitting unit 22*a* is different, and hence the intensity of the light received by the light receiving unit 22*b* is changed. Thereby, the light transmission sensor 22 can detect the position of the print medium M in the feed direction.

In the present embodiment, as shown in FIG. 2, the light emitting unit 22*a* is provided on the opposite side of the feed passage of the print medium M in the partition member 25, that is, on the upper surface side of the partition member 25. In the partition member 25, a through hole 35 through which the light emitted from the light emitting unit 22*a* passes is formed. Meanwhile, the light receiving unit 22*b* is provided on the casing 10 side across the feed passage. Note that the present invention is not limited to this but the light emitting unit 22*a* may be provided on the casing 10 side and the light receiving unit 22*b* may be provided in the partition member 25. A reflection sensor (not shown) may be provided in the partition member 25. This reflection sensor is a sensor having a light emitting portion that emits predetermined light, and a light receiving portion that receives the light emitted from the light emitting portion and then reflected from the print medium M, and outputs an electric signal corresponding to intensity of the received light. The reflection sensor detects the position of the print medium M in the feed direction by detecting match marks which are preliminarily printed on a surface of the print medium M.

Both end portions of the ribbon supply shaft 33 are supported by two support portions 28 turnably and detachably with respect to the partition member 25.

A locking portion 27 projecting from a center portion of the swing shaft 26 is provided in the swing shaft 26. A locked portion 18 to be engaged with the locking portion 27 is provided in the cover 11. In a state where the locking portion 27 is engaged with the locked portion 18, the printing unit 30 is held at an accommodation position where the printing unit is accommodated in the cover 11. A unit lock mechanism 38 that holds the printing unit 30 with respect to the cover 11 is formed by the locking portion 27 and the locked portion 18.

At the time of performing printing by the printer 100, as shown in FIG. 2, the cover 11 is in the close state where the opening portion of the casing 10 is closed.

At the time of performing maintenance of the printer 100, etc., the cover 11 is swung from the close position shown in FIG. 2 to the open position shown in FIG. 3. Thereby, the opening portion of the casing 10 is opened, and it is possible to perform settings of the print medium M to the printer 100 and maintenance of portions in the casing 10.

When the partition member 25 is swung from the close position shown in FIG. 3 to the open position shown in FIG. 4, the ribbon supply shaft 33 and the roll-form ink ribbon R held by the ribbon supply shaft 33 are moved with respect to the ribbon roll up shaft 34, and exposed to the outlet port 16 side of the print medium M.

By operation force to swing the partition member 25 from the close position to the open position, the locking portion 27 and the locked portion 18 are elastically deformed and engagement between both the portions is cancelled.

By cancelling the engagement between the locking portion 27 and the locked portion 18, the printing unit 30 itself is swung to a predetermined exposure position toward the casing 10 side. The predetermined exposure position is a position where a swing regulating portion (not shown) provided in the vicinity of the support shaft 13 in the casing 10 and the main body portion 31 are abutted with each other.

Note that when the printing unit 30 is swung to the casing 10 side with operation force which is predetermined torque or more, the swing regulating portion is elastically deformed, the main body portion 31 goes over the swing regulating portion, and the positioning of the printing unit 30 by the swing regulating portion is cancelled.

In such a way, the partition member 25 and the printing unit 30 are switched from the state shown in FIG. 3 to the state shown in FIG. 4. Thereby, the ribbon supply shaft 33 and the ribbon roll up shaft 34 are arranged at a ribbon replacement position where the shafts are attachable to and detachable from the printer 100, and it is possible to perform a task of replacing the ink ribbon R.

When the partition member 25 is swung from the open position shown in FIG. 4 toward the cover 11 side, the partition member 25 is switched to the close position shown in FIG. 3, and the locking portion 27 and the locked portion 18 are elastically deformed and engaged with each other. By engaging the locking portion 27 and the locked portion 18, the printing unit 30 is held at the accommodation position where the printing unit 30 is accommodated in the cover 11.

The printer 100 includes lock mechanisms 40 that position the partition member 25 with respect to the printing unit 30 when the partition member 25 is placed at the close position. The lock mechanisms 40 stop swing of the partition member 25 with respect to the printing unit 30 by an action of switching the partition member 25 from the open position to the close position.

Hereinafter, configurations of the lock mechanisms 40 will be described with reference to FIG. 5.

Figure 5:
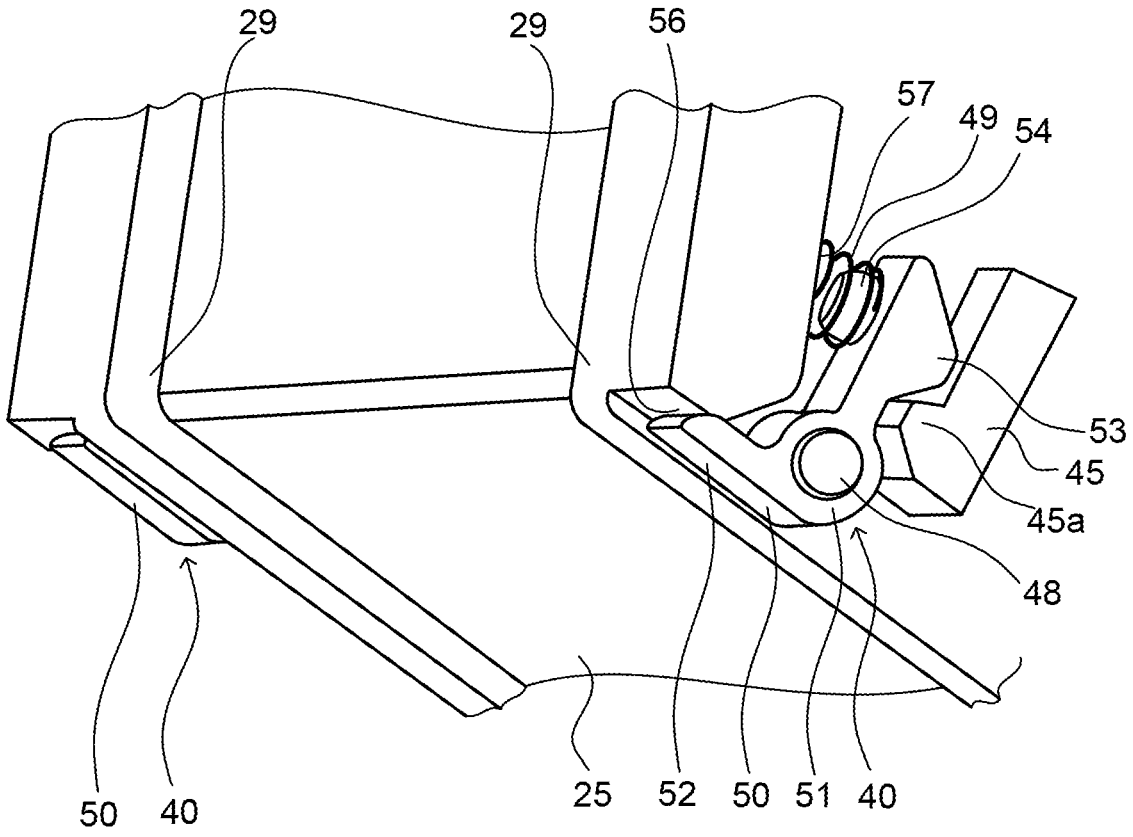
FIG. 5 is a perspective view showing the partition member 25 and lock mechanisms 40.

FIG. 5 is a perspective view showing the partition member 25 and the lock mechanisms 40. The two lock mechanisms 40 are provided in the partition member 25 at a position separated from the swing shaft 26 in the radial direction of the swing shaft 26. The two lock mechanisms 40 are arranged in both end portions of the partition member 25 in the axial direction of the swing shaft 26.

Each of the lock mechanisms 40 has a hook 50 supported swingably about the axis with respect to the partition member 25, and a spring 49 that biases an engagement portion 53 of the hook 50 in the direction in which the engagement portion is engaged with an engaged portion 45 of the main body portion 31.

A support shaft 48 that swingably supports the hook 50 is formed in the partition member 25. The support shaft 48 is arranged in parallel to the swing shaft 26.

The hook 50 has a tubular fitting portion 51 turnably fitted to an outer periphery of the support shaft 48, and the engagement portion 53 and a regulating portion 52 projecting from the fitting portion 51 in the radial direction of the support shaft 48.

An abutment portion 56 to be abutted with the regulating portion 52 to regulate swing of the hook 50, and a spring receiving portion 57 that receives one end of the spring 49 are formed in the partition member 25.

The one end of the coil-shaped spring 49 is supported by the spring receiving portion 57 and the other end is supported by a spring receiving portion 54 of the hook 50.

The engagement portion 53 of the hook 50 projects in a mountain shape toward the engaged portion 45. The engaged portion 45 of the partition member 31 has a mountain portion 45*a* projecting in a mountain shape toward the hook 50.

Hereinafter, actions of each of the lock mechanisms 40 will be described with reference to FIGS. 6A, 6B, and 6C. By the actions shown in order of FIGS. 6A, 6B, and 6C, the lock mechanism 40 cancels holding of the partition member 25, and the partition member 25 is switched from the close position shown in FIG. 3 to the open position shown in FIG. 4. Note that in FIGS. 6A, 6B, and 6C, part of the printer 100 is omitted for simplification of the description.

Figure 6A:
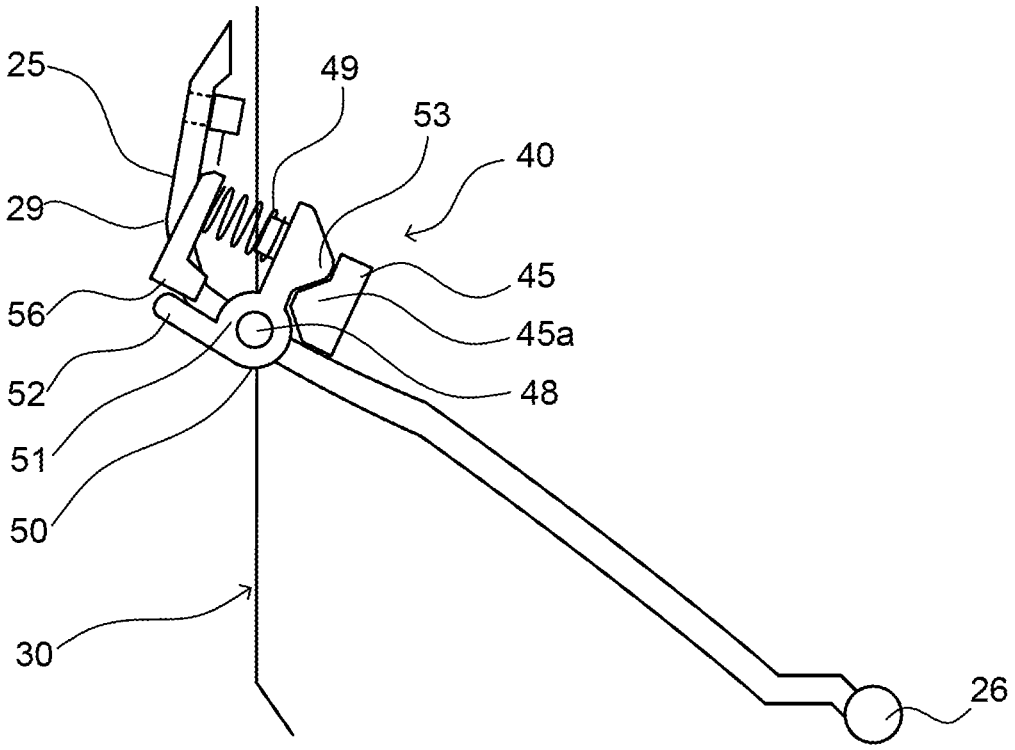
FIG. 6A is a perspective view showing an action of the lock mechanism 40.

As shown in FIG. 6A, in a state where the partition member 25 is placed at the close position, the engagement portion 53 of the hook 50 is engaged with the mountain portion 45*a* of the engaged portion 45 by bias force of the spring 49. Thereby, the partition member 25 is held at the close position.

Figure 6B:
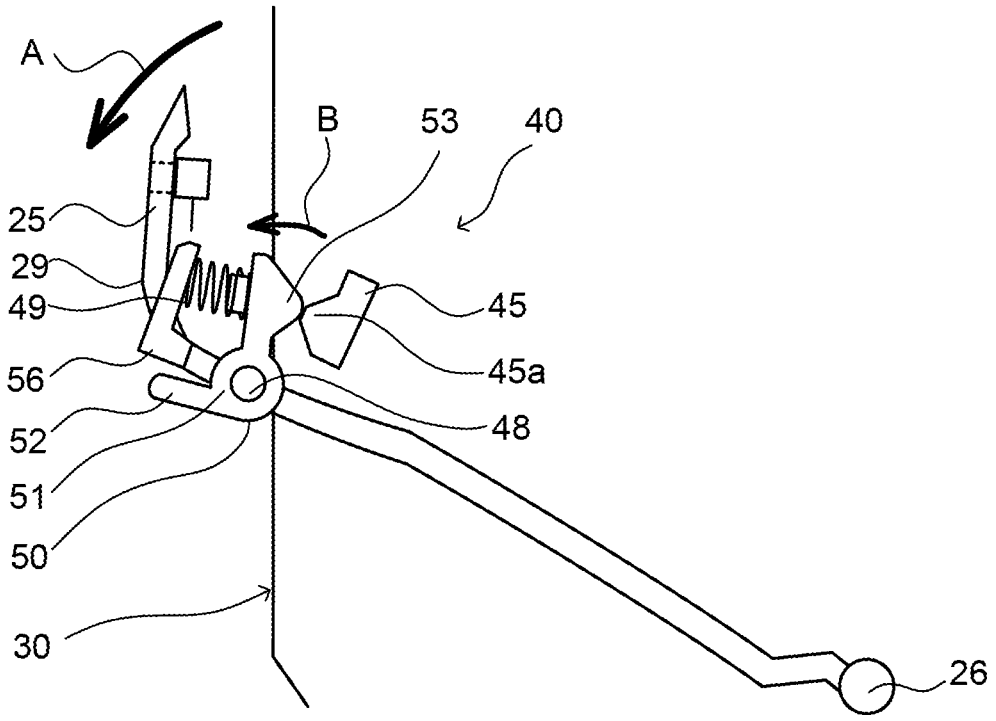
FIG. 6B is a perspective view showing an action of the lock mechanism 40.

As shown by an arrow A in FIG. 6B, when an operator gives operation force which is predetermined torque or more to the partition member 25, the hook 50 is swung in the direction shown by an arrow B against the bias force of the spring 49, the engagement portion 53 goes up onto the mountain portion 45*a* of the engaged portion 45, and the partition member 25 is swung from the close position to the open position.

Figure 6C:
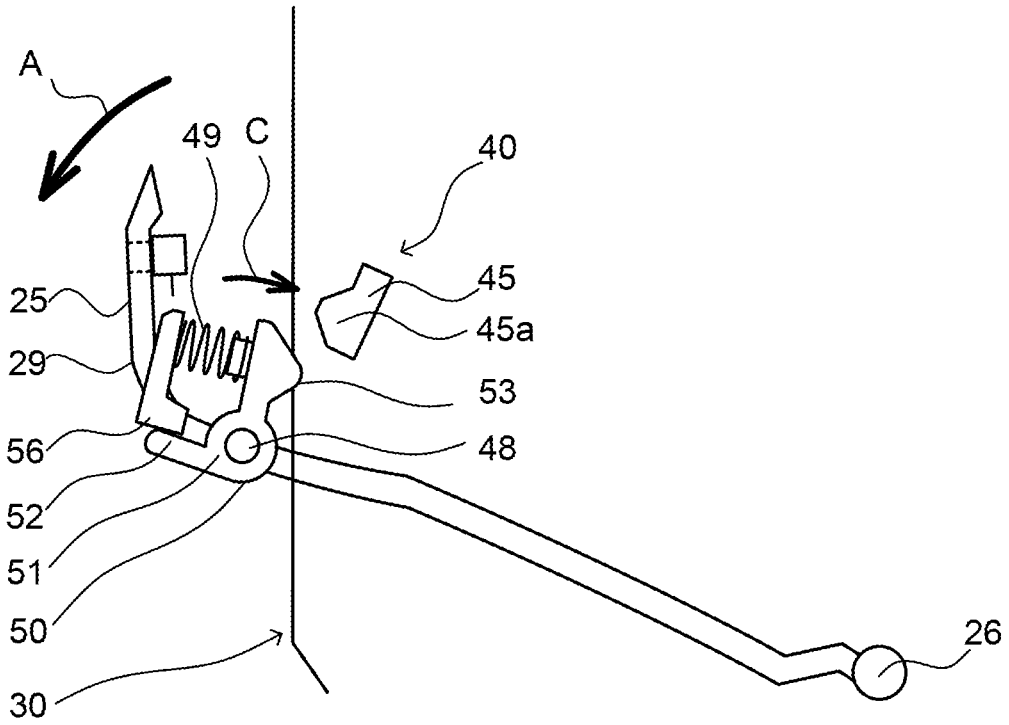
FIG. 6C is a perspective view showing an action of the lock mechanism 40.

As shown in FIG. 6C, when the partition member 25 is successively swung, the engagement portion 53 goes over the mountain portion 45*a* of the engaged portion 45. At this time, the hook 50 is swung in the direction shown by an arrow C in FIG. 6C by the bias force of the spring 49, and the swing of the hook 50 is stopped by abutment of the regulating portion 52 with the abutment portion 56.

In such a way, by an operation of the operator to swing the partition member 25 in the direction of the open position (downward), the state where the partition member 25 is held at the close position by the lock mechanism 40 is cancelled, and the partition member 25 is smoothly switched from the close position to the open position.

Meanwhile, at the time of switching the partition member 25 from the open position shown in FIG. 4 to the close position shown in FIG. 3, the lock mechanism 40 is activated conversely to the above actions shown in order of FIGS. 6A, 6B, and 6C. After going over the mountain portion 45*a* of the engaged portion 45, the engagement portion 53 of the hook 50 is engaged with the mountain portion 45*a* of the engaged portion 45 by the bias force of the spring 49. Thereby, the partition member 25 is positioned at the close position.

Even in a state where the printing unit 30 is placed at the printing position where the printing unit 30 is accommodated in the casing 10 (see FIG. 2), the ribbon supply shaft 33 is held by the lock mechanism 40 together with the partition member 25. Thereby, at the time of activating the printer 100, the state where the gear 65 and the gear 64 of the ribbon supply shaft 33 mesh with each other is held, and the ink ribbon R is smoothly fed.

A facing portion (not shown) that faces the lower surface side of the partition member 25 is provided in the casing 10. Further, a facing portion 58 that faces the regulating portion 52 of the hook 50 is provided in the casing 10. In a state where the printing unit 30 is switched to the printing position where the printing unit is accommodated in the casing 10 (see FIG. 2), the lower surface side of the partition member 25 faces the facing portion (not shown) of the casing 10, and the regulating portion 52 of the hook 50 faces the facing portion 58 of the casing 10. Thereby, in a state where the printing unit 30 is placed at the printing position (see FIG. 2), the swing of the hook 50 is stopped, and the state where the engagement portion 53 and the engaged portion 45 are engaged with each other is reliably maintained.

Next, effects of the present embodiment will be described.

According to the present embodiment, the printer 100 including the printing unit 30 that performs printing to the print medium M, the ribbon supply shaft 33 (ribbon shaft) that holds the ink ribbon R, the partition member 25 provided swingably between the close position where the gears 64 and 65 that transmit drive force to the ribbon supply shaft 33 mesh with each other and the open position where the meshing between the gears 64 and 65 of the gear train 60 is released, and the lock mechanisms 40 that hold the partition member 25 with respect to the printing unit 30 when the partition member 25 is placed at the close position is provided.

With such a configuration, at the time of activating the printer 100, the partition member 25 is held at the close position by the lock mechanisms 40. Thereby, the state where the gears 64 and 65 that drive the ribbon supply shaft 33 mesh with each other is held, and the ink ribbon R is stably fed. Meanwhile, at the time of replacing the ink ribbon R, the partition member 25 is swung to the open position, so that the ribbon supply shaft 33 is arranged detachably from the printing unit 30. Thereby, an operation of attaching and detaching the ink ribbon R in a limited space of the printer 100 is more easily performed, and it is possible to improve replacement workability of the ink ribbon R.

The motor 61 that transmits the drive force to the gear 64 is provided in the casing 10. At the time of activating the printer 100, by holding the partition member 25 at the close position by the lock mechanisms 40, the drive force of the motor 61 is precisely transmitted to the ribbon supply shaft 33 via the gear 64, and the ink ribbon R is stably fed.

The printer 100 includes the light transmission sensor 22 (sensor) having the light emitting unit 22*a* (light emitting portion) and the light receiving unit 22*b* (light receiving portion), the light transmission sensor that detects the position of the print medium M in the feed direction. At least one of the light emitting unit 22*a* and the light receiving unit 22*b* is provided in the partition member 25. At the time of activating the printer 100, by holding the partition member 25 at the close position by the lock mechanisms 40, the light transmission sensor 22 can detect the position of the print medium M in the feed direction with high precision.

The partition member 25 has the guiding surfaces 29 with which the print medium M is brought into sliding contact. At the time of activating the printer 100, by holding the partition member 25 at the close position by the lock mechanisms 40, the print medium M is fed through a predetermined route by the guiding surfaces 29 of the partition member 25. Thereby, printing is performed in the printer 100 with high precision.

The printer 100 includes the cover 11 that opens and closes the casing 10. When the partition member 25 is placed at the close position, the printing unit 30 is accommodated in the cover 11. When the partition member 25 is switched to the open position, the printing unit 30 is exposed from the cover 11. Thereby, by an operation of the partition member 25, the printing unit 30 is exposed from the cover 11. Thus, the operation of attaching and detaching the ink ribbon R is more easily performed, and it is possible to improve the replacement workability of the ink ribbon R.

The printer 100 further includes the unit lock mechanism 38 that holds the printing unit 30 with respect to the cover 11 when the partition member 25 is placed at the close position. At the time of activating the printer 100, by holding the partition member 25 at the close position by the lock mechanisms 40, the printing unit 30 is held at a predetermined printing position with respect to the cover 11 by the unit lock mechanism 38.

The lock mechanism 40 includes the engaged portion 45 provided in the printing unit 30, and the engagement portion 53 to be engaged with the engaged portion 45 by the bias force of the spring 49 following the situation that the partition member 25 is swung and brought to the close position. By the operation force to swing the partition member 25 to the open position, the lock mechanism 40 cancels the engagement between the engagement portion 53 and the engaged portion 45 against the bias force of the spring 49. In such a way, by the lock mechanism 40 being automatically activated by the operation to swing the partition member 25, it is possible to improve the replacement workability of the ink ribbon R.

The lock mechanism 40 includes the hook 50 supported swingably by the partition member 25. The hook 50 has the engagement portion 53, and is swung in the direction in which the engagement portion 53 is engaged with the engaged portion 45 by the bias force of the spring 49.

With such a configuration, in the lock mechanism 40, when the partition member 25 is switched to the close position, the hook 50 is swung by the bias force of the spring 49 and the engagement portion 53 is engaged with the engaged portion 45. Thereby, an operation of the lock mechanism 40 is easily performed, and it is possible to improve the replacement workability of the ink ribbon R.

The printer 100 also includes the casing 10 in which the printing unit 30 is accommodated. The printing unit 30 is switched between the printing position where the printing unit is accommodated in the casing 10 and the non-printing position where the casing 10 is opened. The hook 50 has the regulating portion 52 that regulates the swing of the hook 50 with respect to the casing 10.

With such a configuration, at the printing position where the partition member 25 is accommodated in the printing unit 30, the swing of the hook 50 is stopped by the regulating portion 52 of the hook 50 facing the casing 10, and cancellation of the engagement between the engagement portion 53 and the engaged portion 45 is forbidden. Thereby, even when the printer 100 receives impact from the outside, the state where the engagement portion 53 and the engaged portion 45 are engaged with each other is maintained. Therefore, at the time of activating the printer 100, the state where the gears that drive the ribbon supply shaft 33 mesh with each other is held, and an action to feed the ink ribbon R is smoothly performed.

The swing shaft 26 is provided on the one end side of the partition member 25, and the lock mechanisms 40 are provided on the other end side of the partition member 25.

By providing a sufficient distance between the swing shaft 26 and the lock mechanisms 40 in such a way, the partition member 25 at the close position is reliably positioned. In addition, only small operation force is required for switching the lock mechanisms 40.

The lock mechanisms 40 are arranged in both the end portions of the partition member 25 in the axial direction of the swing shaft 26.

By providing a sufficient gap between the lock mechanisms 40 in such a way, a stable posture of the partition member 25 at the close position is maintained.

The embodiment of the present invention is described above. However, the above embodiment only shows one of application examples of the present invention and there is no intention to limit the technical scope of the present invention to the specific configurations of the embodiment described above.

For example, in the above embodiment, the engaged portion 45 is provided in the partition member 25, and the engagement portion 53 is provided in the printing unit 30. The present invention is not limited to this but the engaged portion 45 may be provided in the printing unit 30 and the engagement portion 53 may be provided in the partition member 25.

The ribbon supply shaft 33 is detachably provided in the partition member 25. However, the present invention is not limited to this but the ribbon roll up shaft 34 may be detachably provided.

The present application claims priority to Japanese Patent Application No. 2018-106519 filed on Jun. 1, 2018 to Japan Patent Office, the entire content of which is incorporated herein by reference.

The invention claimed is:

1. A printer configured to perform printing to a print medium by using an ink ribbon, the printer comprising:

a printing unit configured to print on the print medium;

a ribbon shaft configured to hold the ink ribbon;

a partition member swingably provided between a close position where gears that transmit drive force to the ribbon shaft mesh with each other and an open position where meshing between the gears is released; and a lock mechanism configured to hold the partition member with respect to the printing unit when the partition member is at the close position.

2. The printer according to claim 1, further comprising:

a casing in which the printing unit is accommodated, wherein a motor configured to transmit the drive force to the gears is provided in the casing.

3. The printer according to claim 1, further comprising:

a sensor having a light emitting portion and a light receiving portion, the sensor configured to detect a position of the print medium in a feed direction, wherein at least one of the light emitting portion and the light receiving portion is provided in the partition member.

4. The printer according to claim 1, wherein the partition member comprises guiding surfaces with which the print medium is brought into sliding contact.

5. The printer according to claim 1, further comprising:

a cover configured to open and close a casing of the printer, wherein when the partition member is at the close position, the printing unit is accommodated in the cover, and when the partition member is at the open position, the printing unit is exposed from the cover.

6. The printer according to claim 5, further comprising:

a unit lock mechanism configured to hold the printing unit with respect to the cover when the partition member is at the close position.

7. The printer according to claim 1, wherein the lock mechanism includes:

an engaged portion provided in one of the printing unit and the partition member; and an engagement portion provided in the other one of the printing unit and the partition member, the engagement portion configured to be engaged with the engaged portion by bias force of a spring following movement of the partition member from the open position to the close position, and by an operation force for moving the partition member from the close position to the open position, the lock mechanism is configured to cancel engagement between the engagement portion and the engaged portion against the bias force of the spring.

8. The printer according to claim 7, wherein the lock mechanism further includes:

a hook swingably supported with respect to the printing unit or the partition member, and the hook comprises the engagement portion and is configured to be swung in the direction in which the engagement portion is engaged with the engaged portion by the bias force of the spring.

9. The printer according to claim 8, wherein the hook further comprises a regulating portion configured to regulate swing of the hook with respect to a casing of the printer.

10. The printer according to claim 1, wherein the partition member is supported by the printing unit with one end side of the partition member as a supporting point, and the lock mechanism positions the other end side of the partition member with respect to the printing unit.

11. The printer according to claim 1, wherein the partition member is supported by the printing unit with one end side of the partition member as a supporting point, and lock mechanisms are arranged in both end portions of the partition member in the axial direction of the supporting point.

* * * * *